United States Patent [19]

Gagle et al.

[11] 4,068,968

[45] Jan. 17, 1978

[54] ROADWAY BARRIER STRUCTURE AND METHOD OF MAKING

[75] Inventors: Duane W. Gagle; Homer L. Draper, both of Bartlesville, Okla.

[73] Assignee: Phillips Petroleum Company, Bartlesville, Okla.

[21] Appl. No.: 706,030

[22] Filed: July 16, 1976

[51] Int. Cl.[2] ..... E01C 11/22

[52] U.S. Cl. ..... 404/7; 404/17; 404/28; 404/71

[58] Field of Search ..... 404/7, 8, 27, 18, 82, 404/17, 70, 28, 71

[56] References Cited

U.S. PATENT DOCUMENTS

| | | | |
|---|---|---|---|
| 993,244 | 5/1911 | Hansbrough | 404/7 X |
| 1,473,134 | 11/1923 | Watts | 404/31 |
| 2,333,287 | 11/1943 | Baird | 404/27 X |
| 2,737,092 | 3/1956 | Gramelspacher | 404/28 |
| 3,474,625 | 10/1969 | Draper | 61/1 |
| 3,608,444 | 9/1971 | Levy | 404/82 |
| 3,625,119 | 12/1971 | Gagle | 404/17 |
| 3,680,319 | 8/1972 | Draper | 61/30 |
| 3,698,290 | 10/1972 | Wallace | 404/7 |
| 3,910,710 | 10/1975 | Gagle | 404/28 |
| 3,957,383 | 5/1976 | Fredericks | 404/8 |

*Primary Examiner*—Nile C. Byers

[57] ABSTRACT

A roadway barrier structure is prepared by laying a porous fabric upon a base course, bonding a barrier structure upon a portion of the porous fabric that rests upon the base course, and placing at least a portion of a traffic-bearing course upon a portion of the porous fabric that rests upon the base course and extends beyond the barrier structure.

25 Claims, 3 Drawing Figures

ROADWAY BARRIER STRUCTURE AND METHOD OF MAKING

BACKGROUND OF THE INVENTION

This invention relates to roadway structures. In another aspect this invention relates to roadway structures containing barrier structure. In a further aspect this invention relates to a novel method for preparing barrier structures for roadways.

Roadway barriers, especially asphaltic barriers, such as asphaltic curbs, guides, stops, and dividers, are often used on roadways. The term roadways as used herein as directed to any traffic-bearing surface and thus includes, for example, service roads, secondary roads, access ramps, parking lots, sidewalks, driveways, etc. Conventionally, in preparing asphaltic barriers for such roadways a tack coat of asphaltic binder has been applied to the traffic-bearing surface and then the asphaltic curb has been applied upon the tack coat. In spite of the employment of the tack coat it is often observed that such asphaltic barriers in use tend to break away from the roadway and shift in position when subjected to impacts such as from vehicle tires or wheels. Also, it is often observed that in the face of the elements and impacts the asphaltic barriers tend to crack and crumble. Thus there is a need for more satisfactory roadway barrier structures.

It is an object of this invention to provide a barrier that will have improved resistance to shifting due to impact. A further object of this invention is to provide an asphaltic barrier structure that will have improved resistance to cracking and crumbling.

Other aspects, concepts, objects, and advantages of the present invention will be obvious to those skilled in the art having the benefit of the instant disclosure.

SUMMARY OF THE INVENTION

According to the present invention a barrier for a roadway is prepared by laying a porous fabric upon a base course, bonding a barrier structure upon a portion of the porous fabric that rests upon the base course, and placing at least a portion of a traffic-bearing course upon a portion of the porous fabric that rests upon the base course and extends beyond the barrier structure. The order in which the barrier structure and the traffic-bearing course are placed upon the porous fabric is not critical. In fact, if desired, both can be applied to the porous fabric at the same time. The term bonding as used herein is meant to indicate that materials are held together by something in addition to the gravitational force of the upper material on the lower material.

The barrier structure employed can be constructed of any suitable material. For reasons of economy and convenience, barriers of asphaltic concrete are preferred. Asphaltic concrete is an asphalt composition prepared by mixing aggregate with hot asphalt before the asphaltic material is formed into the desired shape. One conventional method of forming asphaltic concrete barrier structure such as curbs involves the employment of a power driven curb-forming machine which extrudes the barrier structure in the desired shape while the barrier structure is applied to a roadway component.

The base course can be any surface suitable for supporting a trafficbearing course. For example, the base course can consist of a suitable layer of aggregate, an asphaltic traffic-bearing surface that is to be resurfaced, or a Portland cement concrete traffic-bearing surface that is to be resurfaced.

The traffic-bearing course can be of any suitable material, including, for example, macadam, asphaltic concrete, brick, aggregate, or Portland cement concrete. Laying the traffic-bearing course over a portion of the porous fabric that rests upon the base course helps to secure the fabric against movement relative to the base course and thus, in turn, helps to secure the barrier from shifting once the barrier is bonded to the porous fabric.

The porous fabric employed in the present invention can be any porous fabric capable of absorbing adhesive so that a good bond is formed between the fabric and the roadway component to which the fabric is bonded. Examples of such porous fabrics include nonwoven and woven fabrics include nonwoven and woven fabrics of cellulosic, siliceous, and synthetic fibers, and the like. Any suitable thickness of fabric can be employed; however, generally the fabrics employed are from about 1 to about 10 millimeters in thickness under no compression. The more preferable fabrics are from about 1 to about 5 millimeters in thickness under no compression. Nonwoven fabrics of synthetic fibers are particularly suitable. Such nonwoven fabrics are preferably made from polypropylene, polyesters or polyamides. Either heat-sealed or nonheat-sealed, nonwoven fabrics can be employed. Nonwoven synthetic fiber fabrics can be made by forming a batt of randomized synthetic fiber filaments on a continuously moving conveyor which optionally carries a scrim of synthetic fibers and passing this batt through a revolving spindle of needles so that part of the filaments are punched through the scrim and other randomized fibers. In forming heatsealed nonwoven synthetic fiber fabrics a nonwoven fabric structure is formed and the fabric is then subjected to suitable heating. For example the nonwoven fabric structure can be run through rollers at least one of which is heated so that the filaments on at least the top or bottom surfaces of the fabric are fused together where they are in contact. Although the heat-sealed nonwoven synthetic fabrics do contain surfaces having fused fibers, the fabrics still are sufficiently porous to absorb significant amounts of adhesive.

The adhesive employed in bonding the porous fabric to a roadway component according to this invention can be any adhesive which will impede the movement of the fabric relative to the roadway component. Particularly preferred adhesives are those based upon asphalt. Typical asphalt adhesives that can be employed include asphalt cement, asphalt emulsions, and asphaltrubber emulsion. Particularly preferred asphalt adhesives include asphalt cement having a grade of 85/100 under the AASTO-M-20 specification, anionic asphalt emulsions of SS-1, SS-1H, RS-1, and RS-2 grade according to the AASHTO-M-140 specification, cationic asphalt emulsions of grade CRS-2 and CRS-1H under the AASHTO-M-208 specification, and cationic asphalt emulsions such as just mentioned containing in addition 5 weight percent cationic rubber latex based upon the weight of the cationic asphalt emulsion.

In a preferred embodiment of the present invention at least a portion of the porous fabric that rests upon the base course is bonded to the base course as well as being bonded to the barrier structure.

In another embodiment porous fabric completely envelops the barrier structure. Preferably, in this embodiment the porous fabric is a single sheet which is overlapped to completely envelope the barrier in such a fashion that the traffic-bearing surface can be placed upon at least a portion of the overlapped porous fabric which rests upon the base course.

The amount of adhesive used in bonding the porous fabric to a particular roadway component is any amount which will provide a suitable bond between the fabric and the roadway component. Generally, the asphalt adhesives are applied at a rate in the range of about 0.02 to about 0.30 gallon of residual material per square yard. Note that this binder application rate is based upon the residual content. For example, an application rate of 0.25 gallon per square yard, using a cationic asphalt-rubber emulsion having 70 percent residual content, would require 0.36 gallon per square yard of the cationic asphalt-rubber emulsion.

When the barrier structure employed in the present invention is asphaltic concrete which is applied to the porous fabric while in a flowable state the asphaltic concrete will bond the barrier to the porous fabric. It is desirable if at least a portion of the barrier structure is absorbed into at least a portion of the porous fabric.

In another embodiment of the present invention a portion of the porous fabric is wrapped at least part way around the barrier structure to provide the structure with additional reinforcement. Preferably, in this embodiment, the porous fabric is impregnated with asphalt in such a manner that the fabric around the barrier structure will shield the barrier structure from moisture.

Figure 1:
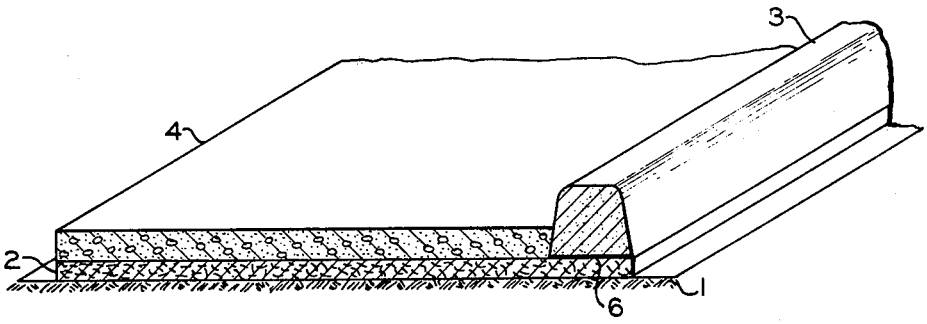
FIG. 1 shows a cross-section of a portion of a roadway containing a barrier structure secured in accordance with this invention.

Referring now to the drawings, in FIG. 1 a porous fabric 2 is shown resting upon a roadway base course 1. Above a portion of the porous fabric 2 is a barrier structure 3. Interposed between the barrier structure 3 and the porous fabric 2 is a layer 6 of asphaltic cement which is absorbed in the upper surface of the porous fabric 2 and which bonds the barrier structure 3 to the porous fabric 2. The porous fabric 2 that rests upon the base course 1 extends beyond the barrier structure 3. Overlying that portion of the porous fabric is a traffic-bearing course.

Figure 2:
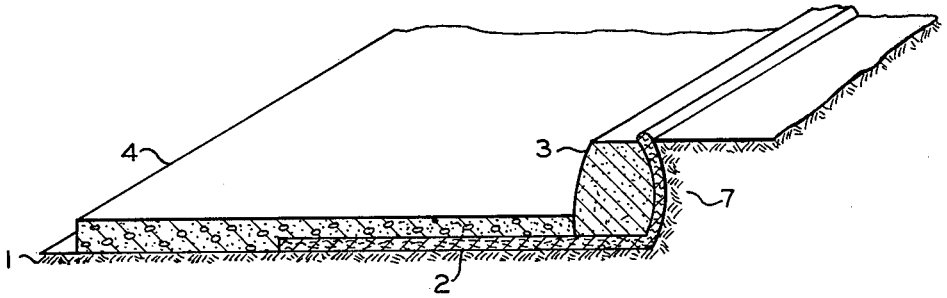
FIG. 2 shows a cross-section of a portion of roadway employing another embodiment of the present invention.

In FIG. 2 a roadway is shown in which an asphaltic concrete barrier structure 3 is provided with additional support by an embankment 7 of the same material as the base course 1. Interposed between the barrier structure 3 and the base course 1 and the barrier structure 3 and the embankment 7 is a porous fabric 2. In this embodiment no adhesive is shown bonding the barrier structure 3 to the porous fabric 2. Instead, in the embodiment shown in FIG. 2 the bond between the porous fabric 2 and the barrier structure 3 is provided by the asphalt absorbed by the porous fabric 2 as hot asphaltic concrete was applied to form the barrier structure 3.

Figure 3:
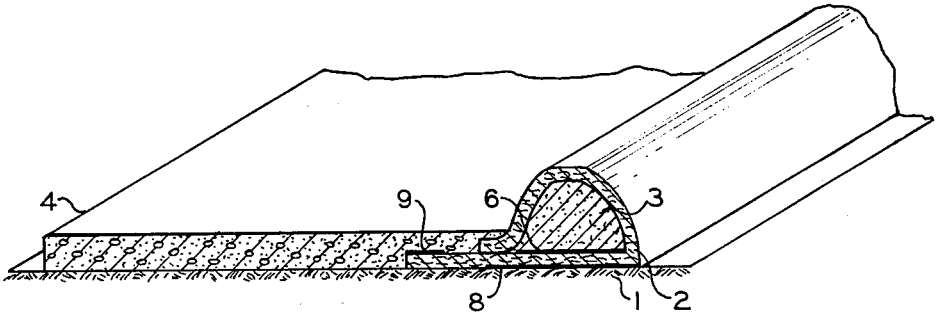
FIG. 3 shows a cross-section of a portion of roadway employing an embodiment of the present invention in which the barrier structure along its length is completely enveloped by the porous fabric.

In FIG. 3 a portion of a roadway is shown in which a single sheet of porous fabric 2 is overlapped to completely envelop the barrier structure 3 along its length. Resting upon the overlapped portion of the porous fabric 2 that rests upon the base course 1 is a portion of the traffic-bearing course. The barrier structure 3 is bonded to the porous fabric by a tack coat of asphaltic cement 6. Also tack coats 8 and 9 of asphaltic cement bond portions of the porous fabric 2 to the base course 1 and the underside of the traffic-bearing course 4.

It is to be noted that those skilled in the art having the benefit of the instant disclosure may recognize obvious variations and modifications of the specific embodiments disclosed herein. It is to be noted that the the specific embodiments herein described and shown in the drawings have been provided merely for the purpose of illustration and should not be interpreted as unduly limiting the present invention which is described in the following claims. For example, although the embodiments illustrated in FIGS. 1 and 2 have the traffic-bearing surface and the barrier structure in abutting relationship, such an arrangement is not essential. Also, it would be within the skill of one skilled in the art to discover optimum sizes for the areas of bonding employed, i.e., between the barrier structure and the porous fabric. While the embodiment shown in FIG. 3 employs bonding tack coats between the porous fabric and both the traffic-bearing course and the base course, either or both of these points of bondingcould be eliminated if deemed desirable. Another variation of the embodiment shown in FIG. 3 would be to use two sheets of porous fabric to envelop the barrier structure, one as a base for the barrier structure and the other to cover the remaining surface of the barrier structure. Further, the overlapping portions of the enveloping porous fabric could be bonded together.

What is claimed is:

1. A roadway structure comprising a base course, a porous fabric at least a portion of which rests upon said base course, a traffic-bearing course resting upon at least a portion of the portion of said porous fabric which rests upon said base course, a barrier structure resting upon and bonded to at least a portion of the portion of said porous fabric which rests upon said base course and extends beyond said traffic-bearing course.

2. A roadway structure according to claim 1 wherein said barrier structure is comprised of asphaltic concrete.

3. A roadway structure according to claim 2 wherein at least a portion of the porous fabric upon which said barrier structure rests contains absorbed in its upper surface at least a portion of the asphaltic material of the barrier structure.

4. A roadway structure according to claim 3 wherein at least a portion of the porous fabric that rests upon the base course is bonded to said base course.

5. A roadway structure according to claim 4 wherein the portion of the porous fabric that is bonded to the base course is bonded by an area of asphalt adhesive on the base course that impregnates at least a portion of the porous fabric resting upon said base course.

6. A roadway structure according to claim 2 wherein at least a portion of said porous fabric is wrapped around said barrier structure.

7. A roadway structure according to claim 6 wherein the portion of said porous fabric that is wrapped around said barrier structure is impregnated with asphalt.

8. A roadway structure according to claim 2 wherein portions of said traffic-bearing course and said barrier structure that rest upon said porous fabric are in abutting relationship.

9. A roadway structure according to claim 2 wherein at least a portion of said traffic bearing course rests upon a portion of said base course where no porous fabric overlies said base course.

10. A roadway structure according to claim 1 wherein said barrier structure is bonded to said porous fabric by a layer of asphalt adhesive which impregnates at least a portion of the top surface of the porous fabric and contacts said barrier structure.

11. A roadway structure according to claim 10 wherein at least a portion of the porous fabric that rests upon the base course is bonded to said base course by a layer of asphalt adhesive which impregnates at least a portion of the bottom surface of the porous fabric and contacts the base course.

12. A roadway structure according to claim 11 wherein at least a portion of the porous fabric underlying the traffic-bearing course is bonded to the traffic-bearing course by a layer of asphalt adhesive which impregnates at least a portion of the top surface of the porous fabric and contacts the traffic-bearing course.

13. A roadway structure according to claim 12 wherein the porous fabric comprises a single sheet which is overlapped to completely envelop the barrier structure along its length.

14. A roadway structure according to claim 13 wherein a portion of the traffic-bearing course overlies a portion of the overlapped porous fabric.

15. A method for preparing an asphaltic barrier upon a roadway comprising laying a porous fabric upon a base course, bonding a barrier structure upon a portion of the porous fabric that rests upon the base course, and placing at least a portion of a traffic-bearing course upon a portion of the porous fabric that rests upon the base course and extends beyond the barrier structure.

16. A method according to claim 15 wherein said barrier structure is comprised of asphaltic concrete and said barrier structure is bonded to said porous fabric by being applied to said porous fabric in a flowable state which allows the porous fabric to absorb some of the asphaltic material.

17. A method according to claim 16 wherein prior to the laying of the porous fabric on the base course, an adhesive is applied to said base course so that at least a portion of the porous fabric that will rest upon the base course will be bonded to said base course.

18. A method according to claim 17 wherein said adhesive is applied to said base course over an area of such size that said porous fabric will be bonded to said base course wherever said porous fabric is to rest upon said base course.

19. A method according to claim 18 wherein all of said barrier structure is placed upon said porous fabric which rests upon said base course.

20. A method according to claim 19 wherein said traffic-bearing course is placed so that it extends to rest upon at least a portion of said base course that does not have said porous fabric resting thereon.

21. A method according to claim 20 wherein said barrier structure and said traffic-bearing course are placed so that they abut.

22. A method according to claim 16 wherein a portion of said fabric extending beyond said barrier course is folded over so that it covers at least part of one side of said barrier structure.

23. A method according to claim 15 wherein prior to the laying of the porous fabric on the base course, an adhesive is applied to said base course so that at least a portion of the porous fabric that will rest upon the base course will be bonded to said base course.

24. A method according to claim 15 wherein said barrier structure and said traffic-bearing course are placed so that they abut.

25. A roadway structure according to claim 1 wherein the upper surface of said barrier structure is higher than the upper surface of the traffic bearing course.

* * * * *